US006942097B1

(12) United States Patent
Stremple et al.

(10) Patent No.: US 6,942,097 B1
(45) Date of Patent: Sep. 13, 2005

(54) PROTECTIVE FOOD STORAGE CONTAINER

(76) Inventors: Paul Stremple, 135 Plymouth St. #306, Brooklyn, NY (US) 11201; Margaret Breuker, 87 Summer St., Manchester by the Sea, MA (US) 01944

( * ) Notice: Subject to any disclaimer, the term of this patent is extended or adjusted under 35 U.S.C. 154(b) by 223 days.

(21) Appl. No.: 10/097,311

(22) Filed: Mar. 14, 2002

(51) Int. Cl.[7] ..... B65D 85/34
(52) U.S. Cl. ..... 206/457; 220/4.23
(58) Field of Search ..... 206/457, 521.2, 206/524.1, 525; 220/4.21–4.23, 810, 811, 220/847, 848, 845; 426/104, 111, 112; 446/73, 446/75, 76

(56) References Cited

U.S. PATENT DOCUMENTS

| | | | | |
|---|---|---|---|---|
| 3,139,348 A | | 6/1964 | Reifers et al. | |
| 3,901,406 A | * | 8/1975 | Kivett | 220/4.21 |
| 3,939,887 A | * | 2/1976 | Scarnato | 426/111 |
| 4,436,203 A | * | 3/1984 | Reyner | 206/457 |
| 4,775,564 A | | 10/1988 | Shriver et al. | |
| 4,795,033 A | | 1/1989 | Duffy | |
| 5,064,398 A | * | 11/1991 | Richardson | 206/457 |
| D345,600 S | | 3/1994 | Woolf | |
| 5,427,233 A | * | 6/1995 | Zinck et al. | 220/4.21 |
| 5,792,496 A | * | 8/1998 | Fekete et al. | 426/104 |
| D401,344 S | | 11/1998 | Bonds | |
| D403,587 S | | 1/1999 | Thornley et al. | |
| D405,531 S | | 2/1999 | Bonds | |
| 5,875,918 A | * | 3/1999 | Sheffler et al. | 220/4.21 |
| 5,941,412 A | * | 8/1999 | Mahoney | 220/847 |
| 6,041,918 A | * | 3/2000 | Moore | 206/457 |
| 6,612,440 B1 | * | 9/2003 | Agulnik | 206/521.2 |

* cited by examiner

*Primary Examiner*—Luan K. Bui
(74) *Attorney, Agent, or Firm*—Brij K. Agarwal; Eckert Seamans Cherin & Mellott, LLC

(57) ABSTRACT

A protective food storage container includes a first member and a second member that are engageable with one another, with at least one of the first and second members being corrugated, and with at least a portion of the first and second members engaged with one another being structured to generally depict a food item such as a banana. Another embodiment of a protective food storage container includes a first member, a second member, and a connection member extending between and connecting together the first and second members. At least a portion of the first and second members engaged with one another are structured to generally depict a food item that can be stored therein such as an apple, a peach, a pear, or a bunch of grapes.

23 Claims, 16 Drawing Sheets

PROTECTIVE FOOD STORAGE CONTAINER

CROSS-REFERENCE TO RELATED APPLICATION

This application is related to commonly owned, concurrently filed United States Design Patent Application Serial No. 29/157,196 filed Mar. 14, 2002, entitled PROTECTIVE FOOD STORAGE CONTAINER.

BACKGROUND OF THE INVENTION

1. Field of the Invention

The present invention relates generally to food storage containers and, more particularly, to a food storage container that is shaped to generally depict a food item that can be stored therein and that is structured to resist crushing of the food item.

2. Background Information

Numerous types of food storage containers are known in the relevant art. Such food storage devices are generally intended to protect a food item or a quantity of food from the deleterious effects of the environment in which the food is placed.

For instance, a bowl-shaped food storage container with a sealable cover may be employed by a user to store therein a quantity of food that may be sticky, such as pudding, or may be of a granular nature, such as peas. In such an application, the food storage container retains the food therein so that, for instance, peas are not rolling around within the interior of a refrigerator. The sealable cover of the food storage container typically may be configured to provide a substantially airtight seal to resist contamination of the food from external sources and to resist dehydration of the food that naturally occurs within a refrigerator.

Food storage containers can be of numerous shapes that are generally suited to different purposes. For instance, some food storage containers are bowl shaped to facilitate the storage and subsequent use of liquid food items. Alternatively, food storage containers may be generally wide, flat, and of a relatively short height in order to store therein generally flat and solid food items, with the relatively short height of the food container facilitating loading into a refrigerator. Other food storage containers may be of a generally cylindrical shape for general storage purposes.

Special storage problems are encountered when it is desired to protect a piece of fresh fruit when transported from one location to another, such as when one carries a piece of fresh fruit from home for consumption during lunch at work, school, and the like. While the piece of fresh fruit may be placed into a known food storage container, most food storage containers that would be sized large enough to accommodate the piece of fresh fruit therein generally are substantially larger than the piece of fresh fruit, thus wasting space within the cramped confines of a briefcase, knapsack, and the like that may be carried from the home to the office or school. Moreover, the piece of fresh fruit disposed within a substantially larger food storage container often will tend to roll or bounce within the food storage container, thus resulting in bruising and other damage to the piece of fresh fruit.

A need thus exists for a protective food storage container that is configured to accommodate a piece of fresh fruit therein and that is configured to resist damaging the piece of fresh fruit. In this regard, it would be preferable to configure the food storage device to closely match the general shape of the piece of fresh fruit in order to minimize bouncing of the piece of fruit within the storage container and consequent bruising thereof, as well as to minimize the space occupied by the food storage container within a briefcase or knapsack. Such a food storage container would also preferably be easy to open, close, and generally use. In this regard, the protective food storage container preferably will include structures or surfaces that can be easily grasped or otherwise manually engaged to permit easy opening of the food storage container, even if the user's fingertips are covered with oils or other substances that may be expected to be on a user's fingers during the course of a meal. Moreover, such a food storage container may preferably include a connection member extending between and connecting together the separate or detachable parts of the food storage container. Such a protective food storage container will preferably also be structured to generally depict the food item carried therein.

It is desired that such a protective food storage container be configured to protect the food item therein, such as a piece of fresh fruit, from damage due to bruising as well as due to environmental effects. Depending upon the specific food item that is to be stored in the protective food storage container, it may be preferable for the food storage container to be configured to bend to accommodate food items of different shapes and sizes yet protect the food item from bruising. Such a protective food storage device may be formed with one or more corrugations for such purpose.

SUMMARY OF THE INVENTION

In view of the foregoing, a protective food storage container includes a first member and a second member that are engageable with one another, with at least one of the first and second members being corrugated, and with at least a portion of the first and second members engaged with one another being structured to generally depict a food item such as a banana. Another embodiment of a protective food storage container includes a first member, a second member, and a connection member extending between and connecting together the first and second members. At least a portion of the first and second members engaged with one another are structured to generally depict a food item that can be stored therein such as an apple, a peach, a pear, or a bunch of grapes.

An aspect of the present invention is to provide a protective food storage container that can retain therein a food item such as a piece of fresh fruit.

Another aspect of the present invention is to provide a protective food storage container that resists crushing of a food item such as a piece of fresh fruit.

Another aspect of the present invention is to provide a protective food storage container that includes one or more corrugations to provide flexibility to the protective food storage container and to resist crushing of a food item that can be stored therein, such as piece of fresh fruit.

Another aspect of the present invention is to provide a protective food storage container having a first member and a second member, with a connection member such as hinge extending between the first and second members.

Another aspect of the present invention is to provide a protective food storage container that can store a food item therein and that is structured to generally depict the food item.

Accordingly, an aspect of the present invention is to provide a protective food storage container being formed with a cavity that is structured to receive a non-liquid food item therein, with the protective food storage container being structured to resist crushing of the food item, in which the general nature of the protective food storage container can be stated as including a first member and a second member, the first member and the second member being engageable with one another, at least one of the first member and the second member including at least a first corrugation, the cavity being formed in at least one of the first member and the second member and extending at least partially through the at least first corrugation, and at least a portion of the first member and the second member engaged with one another being structured to generally depict the food item.

Another aspect of the present invention is to provide a protective food storage container being formed with a cavity that is structured to receive a non-liquid food item therein, with the protective food storage container being structured to resist crushing of the food item, in which the general nature of the protective food storage container can be stated as including a first member, a second member, and a connection member extending between and connecting together the first member and the second member, the first member and the second member being engageable with one another, the cavity being formed in at least one of the first member and the second member, and at least a portion of the first member and the second member engaged with one another being structured to generally depict the food item.

BRIEF DESCRIPTION OF THE DRAWINGS

A further understanding of the invention can be gained from the following description of the preferred embodiments when in conjunction with the accompanying drawings in which.

Similar numerals refer to similar parts throughout the specification.

DESCRIPTION OF THE PREFERRED EMBODIMENTS

Figure 1:
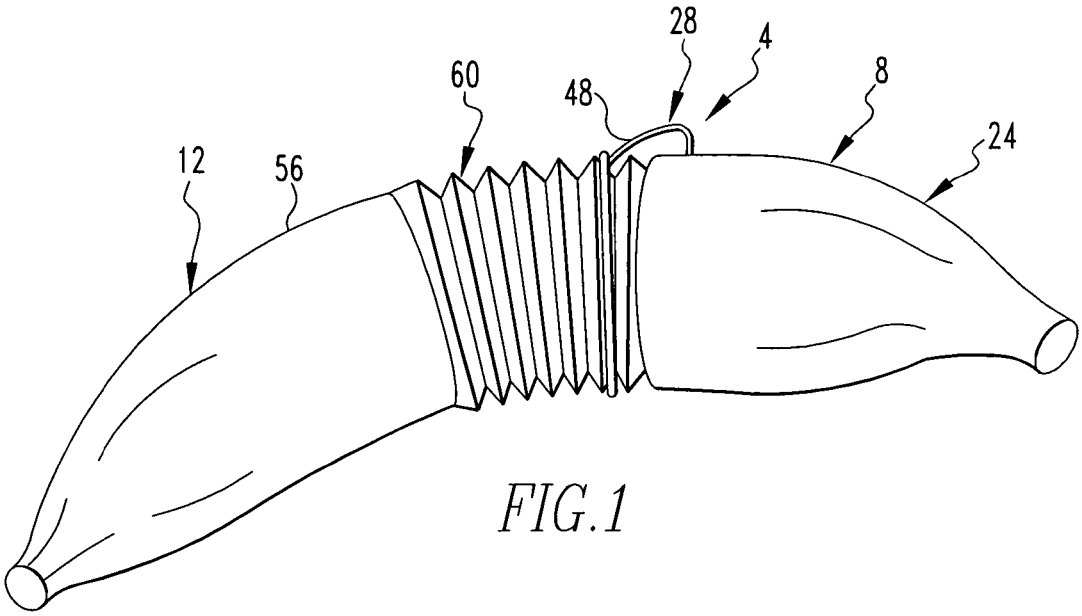
FIG. 1 is a perspective view of a protective food storage device in accordance with a first embodiment of the present invention.

A protective food storage container 4 in accordance with a first embodiment of the present invention is indicated generally in FIGS. 1–6. The container 4 includes a first member 8 and a second member 12 that are detachably engageable with one another. The protective food storage container is formed with a cavity 16 (FIG. 3) internal thereto within which a food item 20 (FIGS. 3 and 6) can be protectively stored. In accordance with an aspect of the present invention, the container 4 is structured to generally depict the food item 20 which, in the example indicated in FIGS. 1–6, is a banana. As will be set forth more fully below, the container 4 is configured not only to generally depict the food item 20, but is also advantageously configured to protect the food item 20 from damage due to bruising and the like, and is flexible or adjustable to accommodate food items 20 therein having different shapes.

Figure 2:
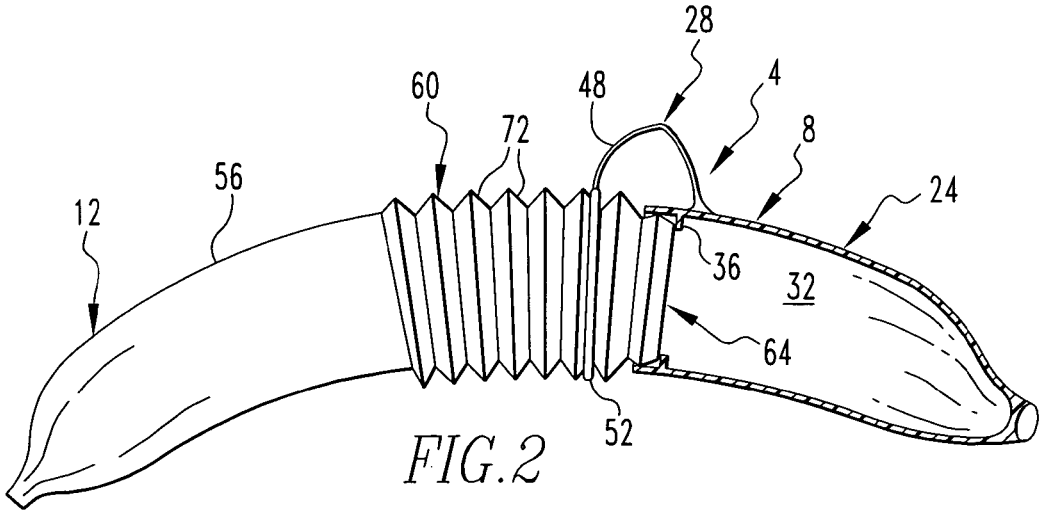
FIG. 2 is a side elevational view of the first embodiment, partially cut away.
Figure 3:
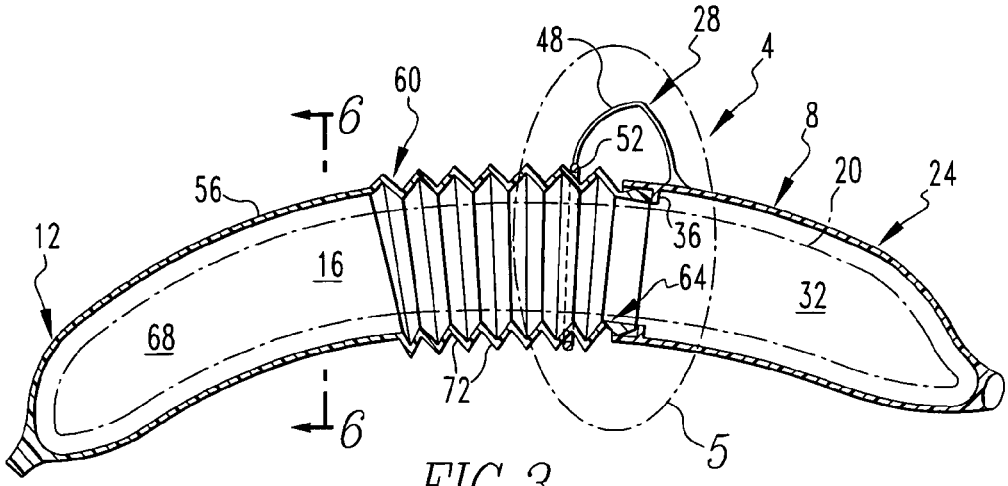
FIG. 3 is a cut away side elevational view of the first embodiment.
Figure 4:
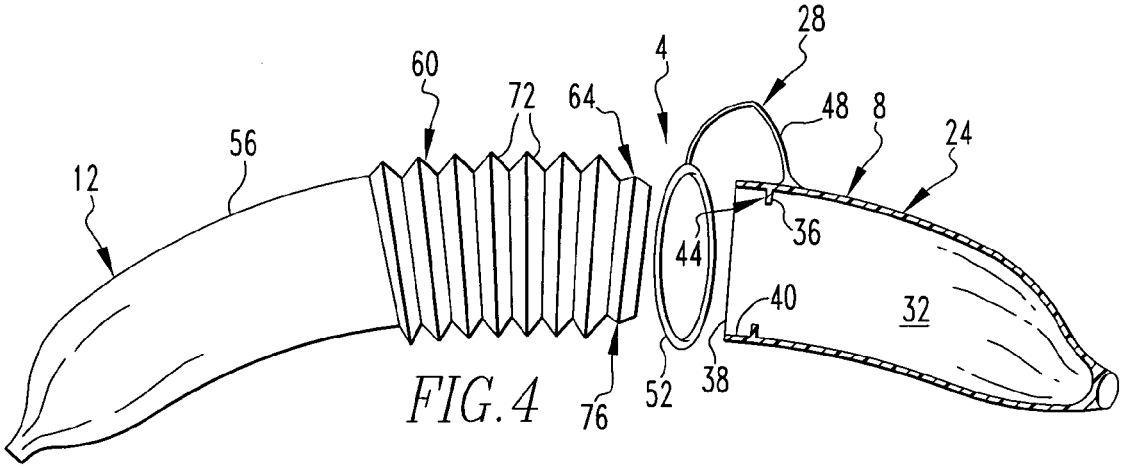
FIG. 4 is a view similar to FIG. 2, except depicting the first embodiment in an exploded configuration.

As is best shown in FIGS. 2–4, the first member 8 includes a first banana portion 24 and a connection member 28. The first member 8 is also configured to include a first cavity portion 32 that makes up a portion of the cavity 16 when the first member 8 is engaged with the second member 12.

The first member 8 additionally includes a generally annular flange 36 disposed within the first cavity portion 32 and spaced slightly from an open end 38 (FIGS. 4 and 5) of the first banana portion 24. The region of the first cavity portion 32 extending between the flange 36 and the open end 38 defines a socket 44 that can receive a portion of the second member 12 therein, as will be set forth more fully below. The socket 44 includes a generally arcuate mounting surface 40 defined on an inner surface of the first banana portion 24 between the flange 36 and the open end 38.

As is best shown in FIG. 4, the connection member 28 includes a strap 48 and a ring 52. One end of the strap 48 is fixedly connected with the first banana portion 24, and the ring 52 is fixedly disposed on an end of the strap 48 opposite the first banana portion 24. In the embodiment of the container 4 depicted generally in FIGS. 1–6, the first banana portion 24, the strap 48, and the ring 52 are monolithically formed as a single piece.

The second member 12 includes a second banana portion 56, a corrugated portion 60 and a boss 64. The corrugated portion 60 can be seen as being disposed generally between the second banana portion 56 and the boss 64. The second member 12 is additionally configured to include a second cavity portion 68 that provides a portion of the cavity 16 when the first and second members 8 and 12 are engaged with one another.

It can be seen that the corrugated portion 60 includes a plurality of corrugations 72. The corrugations 72 resist crushing of the container 4, which resists bruising or other damage to the food item 20. Additionally, the corrugations provide flexibility to the container 4, as will be set forth more fully below.

Figure 5:
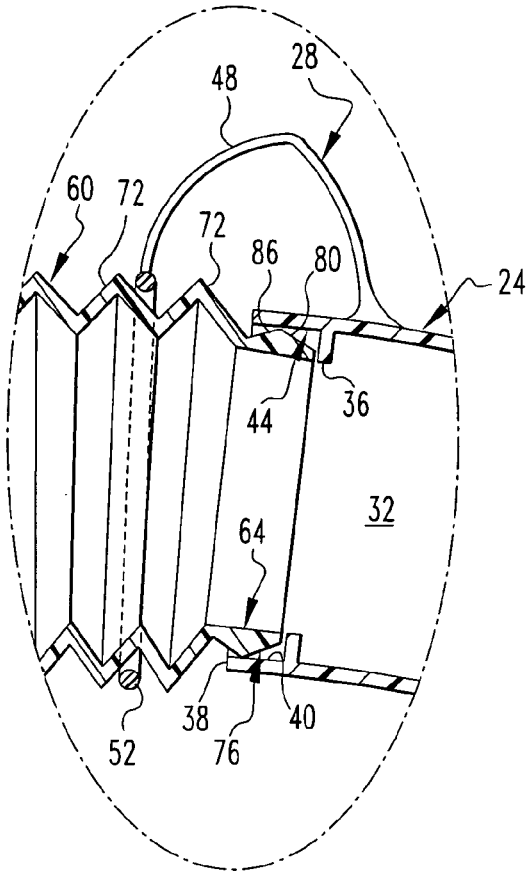
FIG. 5 is an enlarged view of the encircled portion of FIG. 3.

As is best shown in FIGS. 4 and 5, the boss 64 includes a protrusion 76 that extends circumferencially around the boss 64 and protrudes radially outwardly therefrom. The protrusion 76 includes a tapered insertion surface 80 (FIG. 5) that is provided for purposes that will be set forth more fully below.

As can be seen in FIGS. 2, 3, and 5, the boss 64 is receivable in the socket 44 to cause the first and second members 8 and 12 to be engaged with one another. When the boss 64 is received in the socket 44, it can be seen that the protrusion 76 is disposed against the mounting surface 40. In this regard, it is understood that the boss 64 and the socket 44 are complementarily shaped and are configured such that a slight interference fit exists between the protrusion 76 and the mounting surface 40. Such an interference fit retains the boss 64 within the socket 44 to thus retain the first member 8 engaged with the second member 12 until it is desired that they be disengaged or separated. In engaging the first and second members 8 and 12 together, the boss 64 is slidingly received in the socket 54 with the aforementioned slight interference fit therebetween. As such, the tapered insertion surface 80 is advantageously provided on the boss 64 to assist the protrusion 76 in overcoming the slight interference fit with the socket 44 to enable engagement of the first member 8 with the second member 12.

It can also be seen that the protrusion 76 includes a tapered removal surface 86 (FIG. 5) opposite the tapered insertion surface 80 which facilitates detachment of the first and second members 8 and 12 to effect disengagement thereof. It thus can be seen that the protrusion 76 being disposed against the mounting surface 40, and the consequent engagement therebetween, retains the first and second members 8 and 12 engaged with one another. The tapered insertion and removal surfaces 80 and 86 assist with engagement and disengagement therebetween, respectively.

The container 4 is depicted in FIG. 4 as being in an exploded condition. It thus can be seen that the ring 52 can be detached from the corrugated portion 60 of the second member 12. When the ring 52 is attached to the corrugated portion 60, the ring 52 extends around at least one of the corrugations 72. As such, it can be seen that the first and second members 8 and 12 can be engaged and disengaged with one another due to the boss 64 being received in and removed from the socket 44, as set forth above. Additionally, when the ring 52 is removed from the corrugated portion 60, the first and second members 8 and 12 are detached from one another.

In use, the first and second members 8 and 12 are disengaged from one another, and the food item 20 is received in the second cavity portion 68. In so doing, at least a portion of the food item 20 may protrude out of the second member 12 beyond the boss 64. The first member 8 is then manipulated such that the protruding end of the food item 20 is received in the first cavity portion 32, and the first and second members 8 and 12 are then engaged with one another by receiving the boss 64 in the socket 44. In so doing, the tapered insertion surface 80 facilitates reception of the boss 64 in the socket 44. The boss 64 is slidingly received in the socket 44 until the boss 64 engages the flange 36, which operates as a stop.

It is understood that a food item 20 such as a banana is of a generally non-circular shape (FIG. 6) and rather is of a curved or crescent shape. Different bananas have different cross sectional configurations and crescent shapes. In order to permit the container 4 to accommodate food items 20 such as bananas of different shapes, the corrugations 72 permit the container 4 to be flexed such that the first banana portion 24 is generally flexible with respect to the second banana portion 56. Such flexibility permits food items 20 such as bananas of varying shapes and sizes to be received within the cavity 16. In this regard, it can be seen that the cavity 16 extends through the corrugated portion 60 and thus through each of the corrugations 72, as well as extends through the boss 64.

Further in accordance with an aspect of the present invention, the corrugations 72 each resist crushing of the container 4. In accordance with known principles, the corrugations 72 increase the area moment of inertia of the container 4 along transverse planes which resists crushing of the container 4 with consequent protection of the food item 20 disposed within the cavity 16.

As can be seen in FIGS. 1–6, the container 4 is advantageously structured to generally depict the food item 20 which, in the example given in FIGS. 1–6, is a banana. The first and second banana portions 24 and 56 are more particularly structured to depict portions of a banana, and additionally depict a stem and a blossom end opposite one another.

The container 4 thus protects the food item 20 from bruising, is flexible enough to accommodate therein food items 20 of different shapes and sizes, and is appealing in its general appearance. Moreover, the cavity is configured to receive the food item 20 therein without permitting significant movement of the food item 20 within the cavity 16, which further resists bruising of the food item 20. As such, the container 4 occupies a minimum amount of space, i.e., generally that space occupied by the food item 20 plus an additional nominal amount of space to provide protection to the food item 20.

Figure 7:
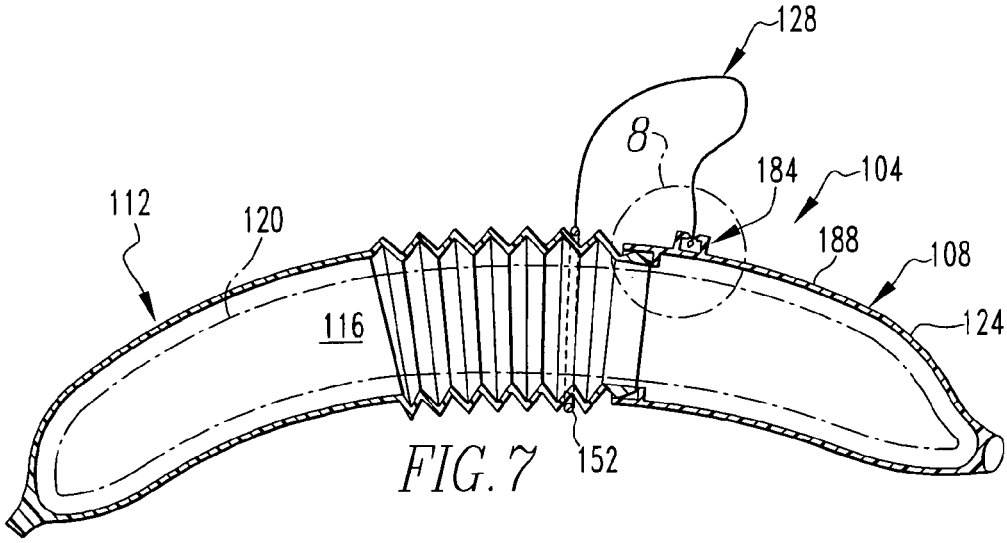
FIG. 7 is a cut away side elevational view of a protective food storage container in accordance with a second embodiment of the present invention.
Figure 6:
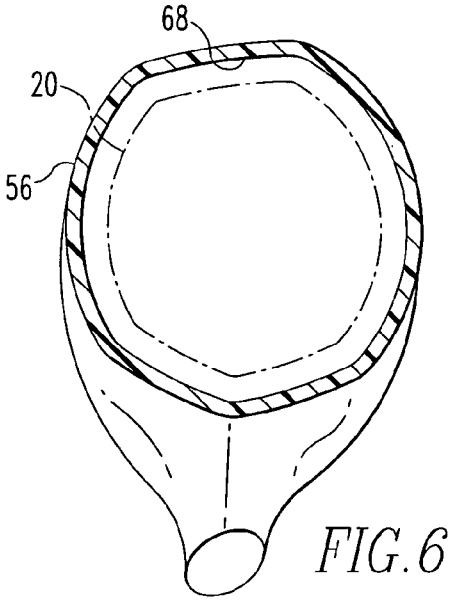
FIG. 6 is a sectional view as taken along line 6—6 of FIG. 3.

A protective food storage container 104 in accordance with a second embodiment of the present invention is indicated generally in FIGS. 6 and 7. The container 104 is similar to the container 4 in that it includes first and second members 108 and 112 that are configured to include a cavity 116 formed therein that can accommodate a food item 120. In this regard, the first member 108 includes a first banana portion 124 and a connection member 128. However, the first member 108 additionally includes a lock member 184 that can detachably receive a portion of the connection member 128 therein.

Figure 8:
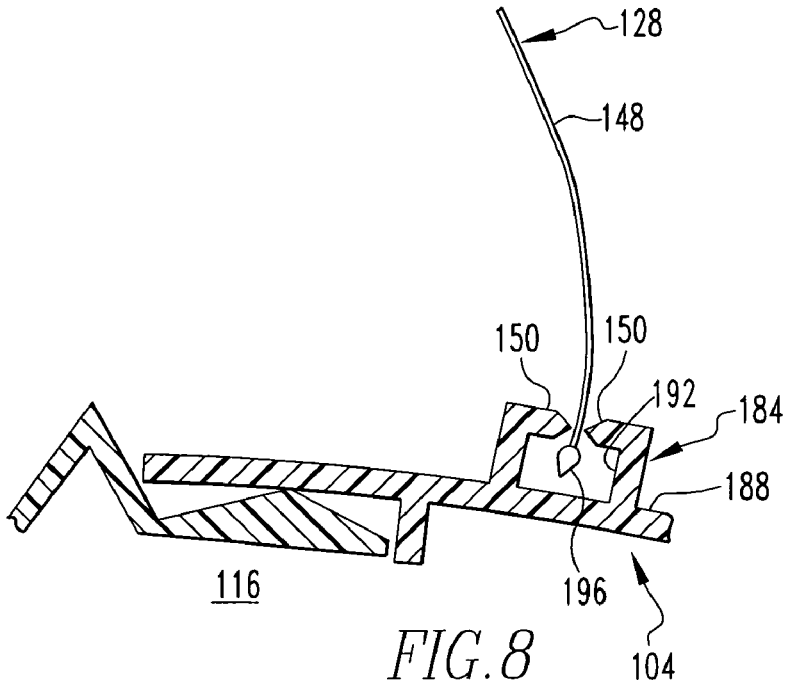
FIG. 8 is an enlarged view of the encircled portion of FIG. 7.

As is best shown in FIG. 8, the lock member 184 protrudes outwardly from an outer surface 188 of the first member 108. The lock member 184 is configured to include an interior 192 as well as a pair of flexible retention members 150 that extend toward one another from opposite sides of the lock member 184. The interior is defined by the retention members 150.

The connection member 128 includes a strap 148, a ring 152, and a bulb 196. The ring 152 and bulb 196 are disposed at opposite ends of the strap 148. As is best shown in FIG. 8, the bulb 196 is receivable in the interior 192 of the lock member 184 by slightly flexing the retention members 150 to permit the bulb 196 to move therepast.

The lock member 184 can be monolithically formed as a single piece. Similarly, the first banana portion 124 together with lock member 184 can be monolithically formed as a single piece.

It thus can be seen that by configuring the first member 108 as depicted in FIGS. 7 and 8, the connection member 128 can be detached from either of the first and second members 108 and 112, and additionally can be entirely removed from the container 104. Such a configuration adds greater versatility to the function and appearance of the container 104.

Figure 9:
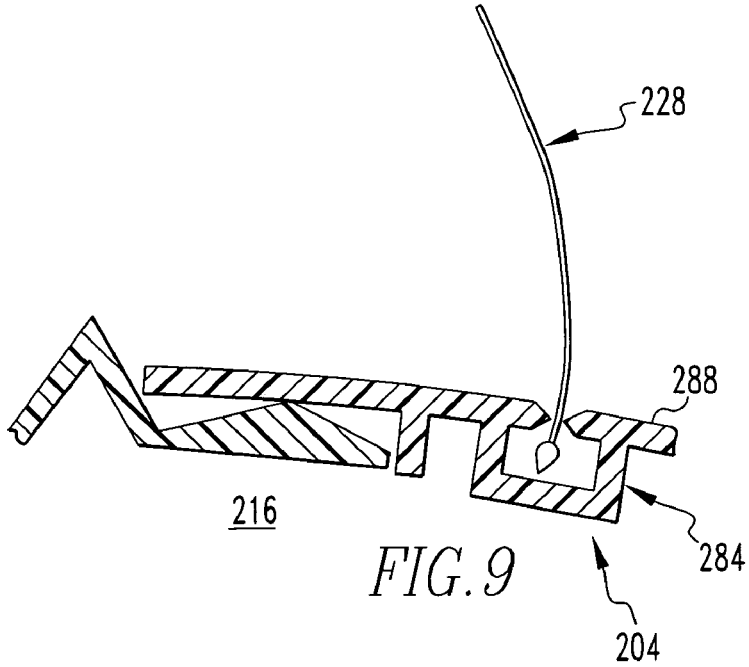
FIG. 9 is a view similar to FIG. 8, except depicting a protective food storage container in accordance with a third embodiment of the present invention.
Figure 10:
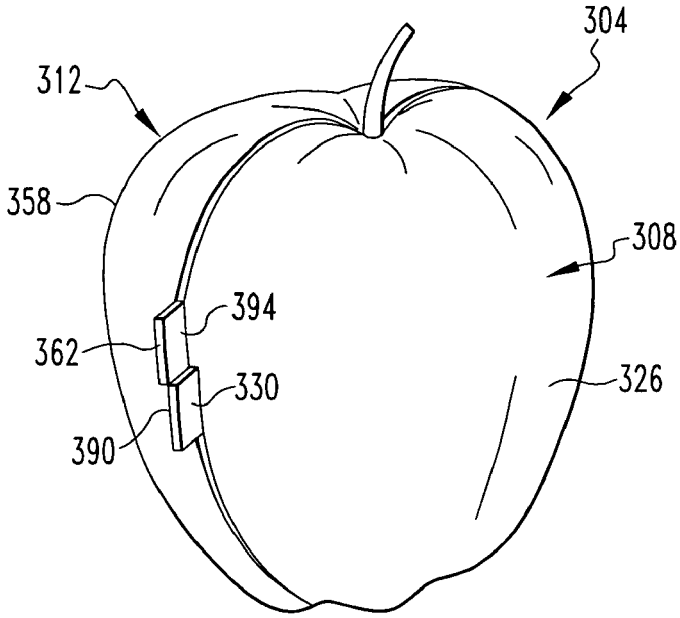
FIG. 10 is a perspective view of a protective food storage container in accordance with a fourth embodiment of the present invention.
Figure 11:
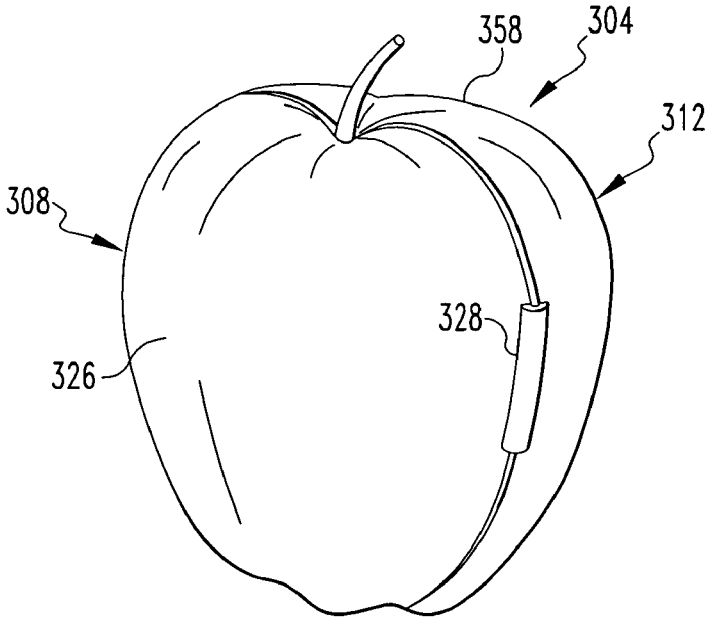
FIG. 11 is a perspective view of the fourth embodiment.
Figure 12:
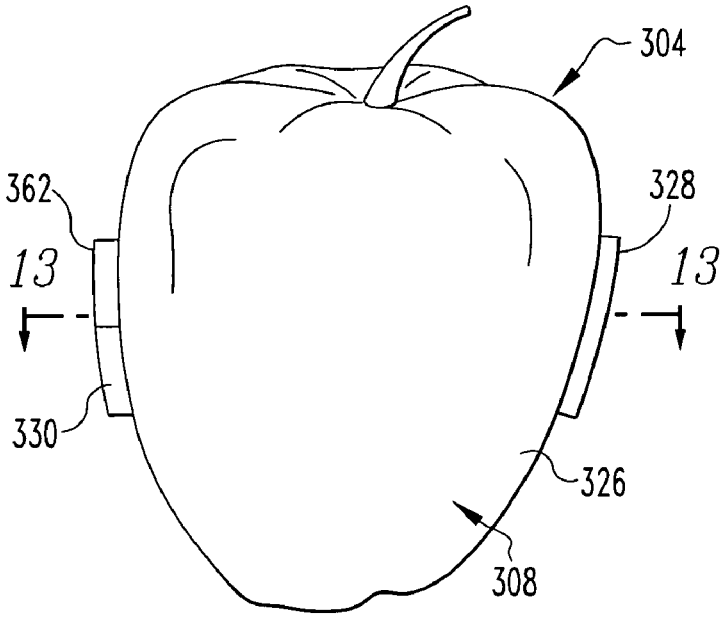
FIG. 12 is a front elevational view of the fourth embodiment.

A protective food storage container 204 in accordance with a third embodiment of the present invention is indicated generally in FIG. 9. FIG. 9 illustrates that the container 204 is similar to the container 104, except that the lock member 284 is recessed below the outer surface 288 and is thus disposed within the cavity 216. The lock member 284 provides the same detachability of the connection member 228, and further provides versatility to the appearance and function of the container 204.

A protective food storage container 304 in accordance with a fourth embodiment of the present invention is indicated generally in FIGS. 10–15. The container 304 includes a first member 308, a second member 312, and a connection member 328 extending therebetween. The container 304 is configured to include a cavity 316 formed therein that can protectively retain a food item 320 therein. The container 304 is advantageously structured to generally depict the food item 320 which, in the example shown in FIGS. 10–15 is an apple. As will be set forth more fully below, the first and second members 308 and 312 are engageable with one another to removably retain the food item 320 within the cavity 316.

The first member 308 includes a first apple portion 326 and a first tab 330. The first apple portion 326 is generally concave in shape such that it includes a first cavity portion 332 that becomes a part of the cavity 316 when the first and second members 308 and 312 are engaged with one another. The first apple portion 326 also is formed with a shallow socket 344 (FIGS. 14–15) that can engageably receive a portion of the second member 312 therein. The socket 344 includes a generally arcuate mounting surface 340 defined thereon that can be engaged by the aforementioned portion of the second member 312 that is received in the socket 344. Additionally, the first apple portion 326 includes a generally annular first confronting surface 346 that faces generally toward the second member 312.

The first tab 330 protrudes outwardly from the first apple portion 326 in a direction generally parallel with the plane of the first confronting surface 346. In the embodiment of the container 304 depicted generally in FIGS. 10–15, the first tab 330 includes a first surface 390 that is generally coplanar with the first confronting surface 346. As will be set forth more fully below, the first tab 330 facilitates engagement and disengagement of the first and second members 308 and 312 with one another.

The second member 312 includes a second apple portion 358, a second tab 362, and a boss 364. The second member 312 is generally concave in configuration and includes a second cavity portion 368 formed therein that becomes a part of the cavity 316 when the first and second members 308 and 312 are engaged with one another. The second apple portion 358 includes a generally annular second confronting surface 382 that faces generally toward the first apple portion 326. The boss 364 extends around the circumference of the second apple portion 358 adjacent the second confronting surface 382 and extends in a direction generally away from the second apple portion.

The second tab 362 protrudes outwardly from the second member 312 in a direction generally parallel with the second confronting surface 382. In this regard, the exemplary second tab 362 of the container 4 includes a second surface 394 (FIG. 14) that is generally coplanar with the second confronting surface 382.

Figure 13:
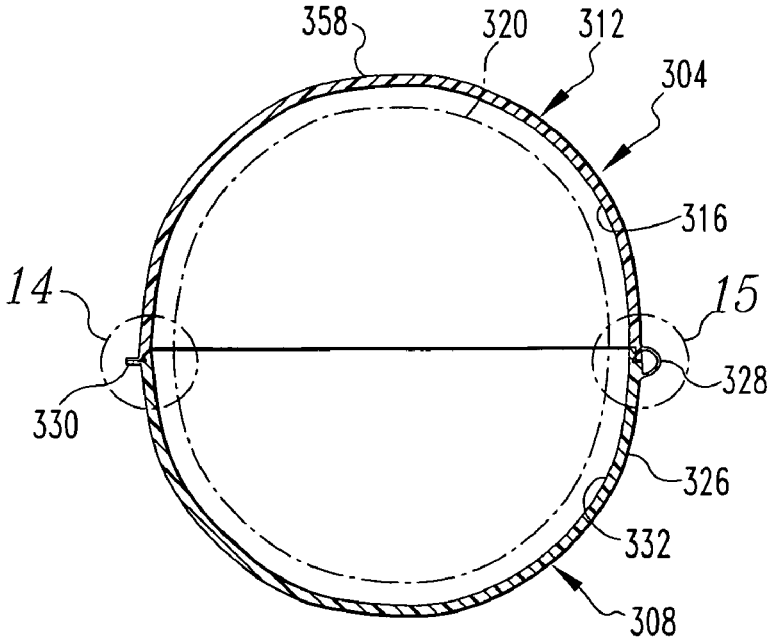
FIG. 13 is a sectional view as taken along the line 13—13 of FIG. 12.
Figure 14:
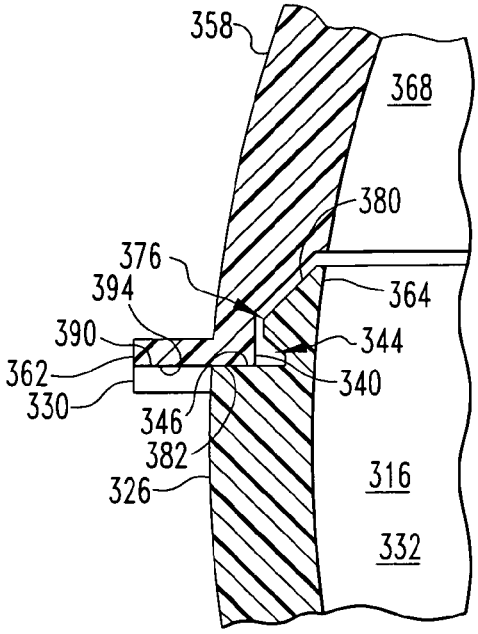
FIG. 14 is an enlarged view of an encircled portion of FIG. 13.
Figure 15:
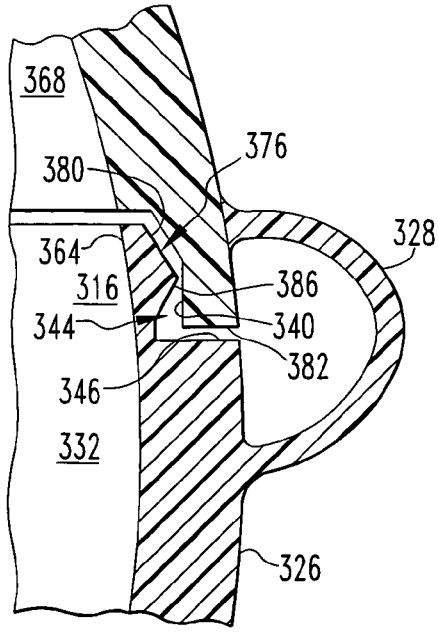
FIG. 15 is an enlarged view of an encircled portion of FIG. 13.
Figure 16:
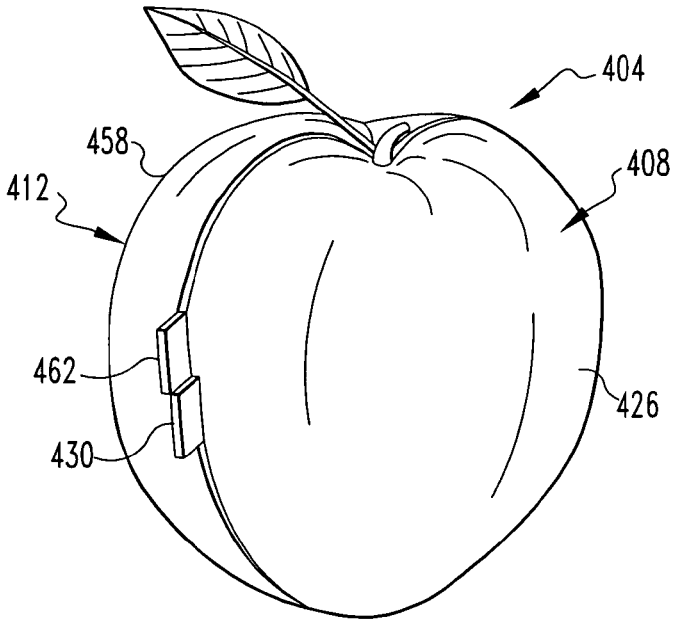
FIG. 16 is a perspective view of a protective food storage container in accordance with a fifth embodiment of the present invention.
Figure 17:
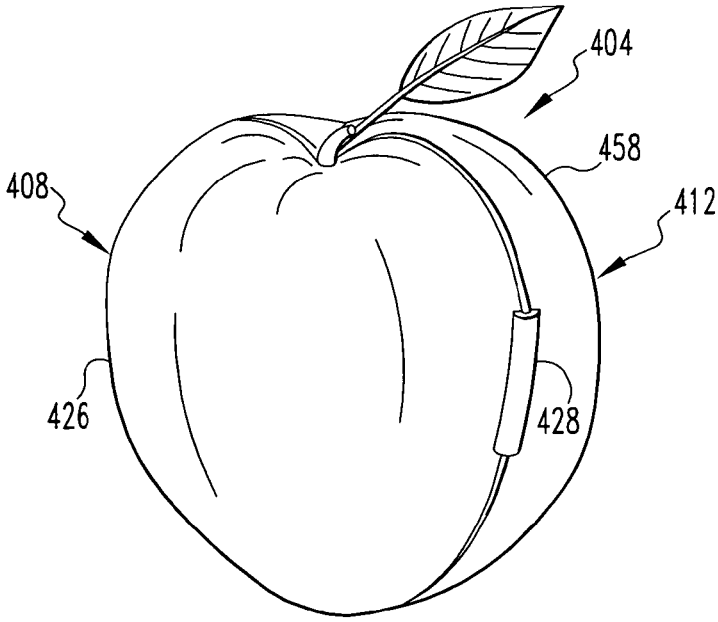
FIG. 17 is a perspective view of the fifth embodiment.
Figure 18:
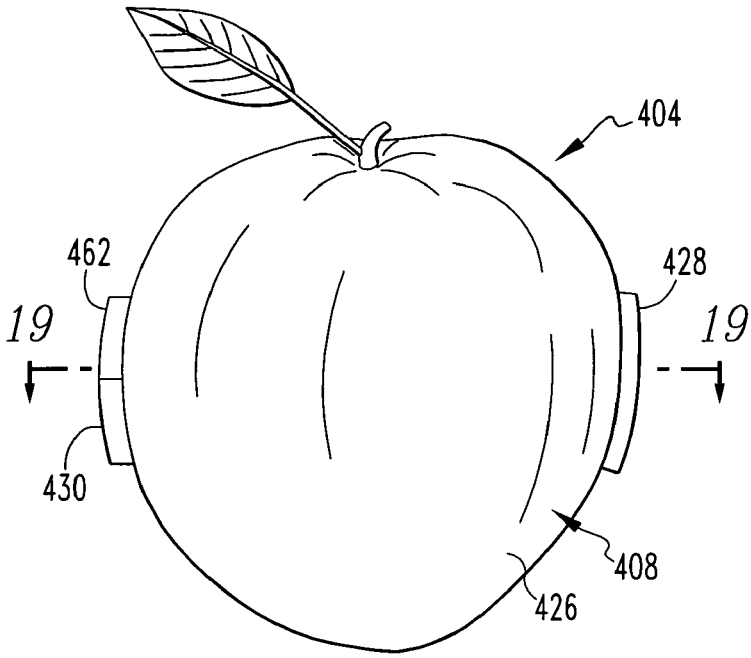
FIG. 18 is a front elevational view of the fifth embodiment.
Figure 19:
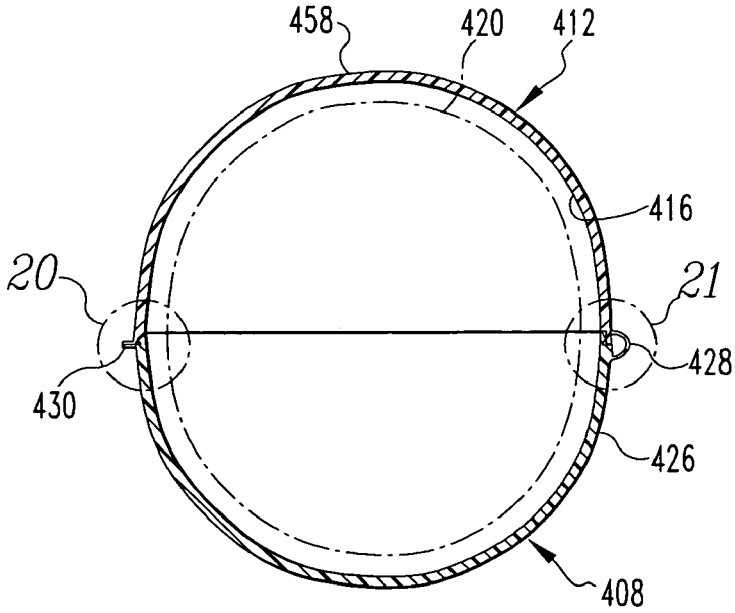
FIG. 19 is a sectional view as taken along the line 19—19 of FIG. 18.
Figure 20:
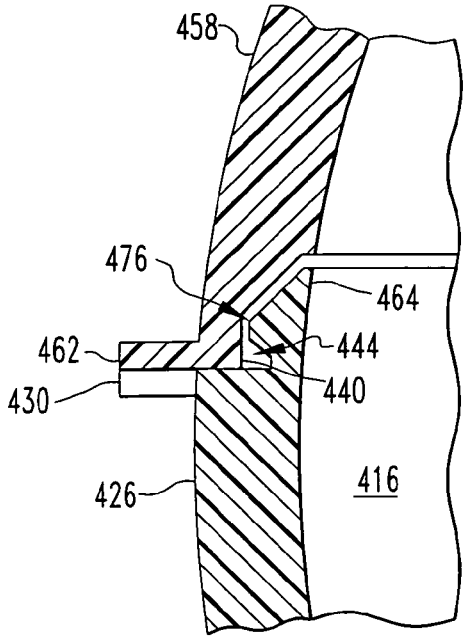
FIG. 20 is an enlarged view of an encircled portion of FIG. 19.
Figure 21:
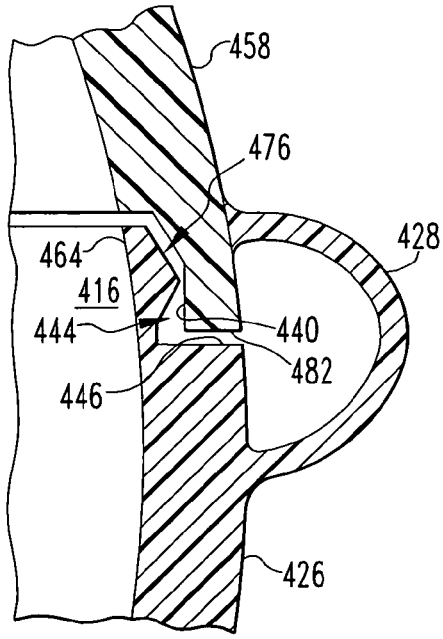
FIG. 21 is an enlarged view of an encircled portion of FIG. 19.
Figure 22:
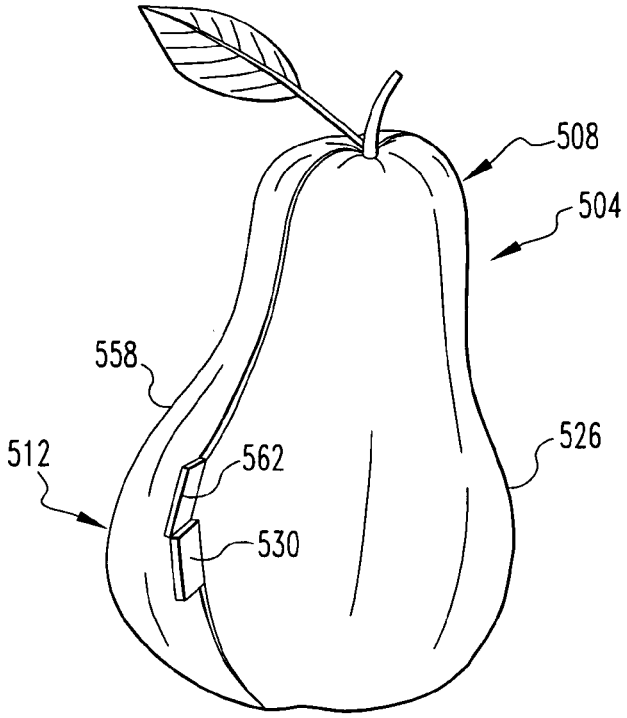
FIG. 22 is a perspective view of a protective food storage container in accordance with a sixth embodiment of the present invention.
Figure 23:
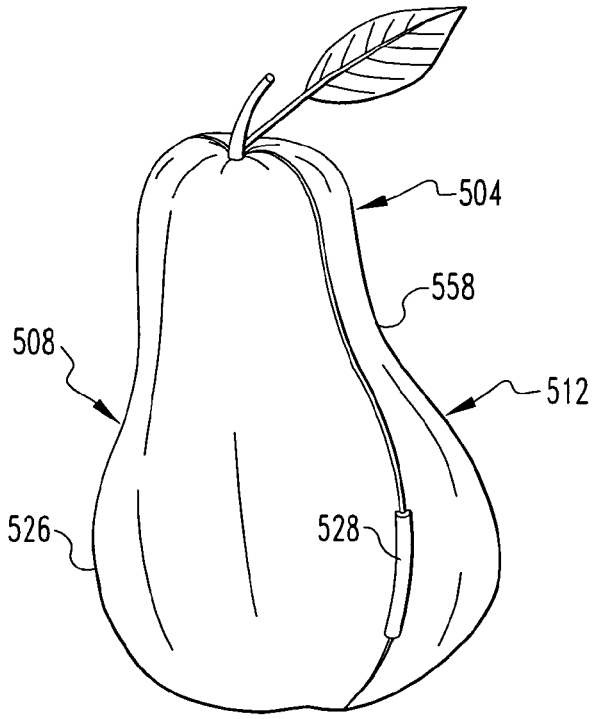
FIG. 23 is a perspective view of the sixth embodiment.
Figure 24:
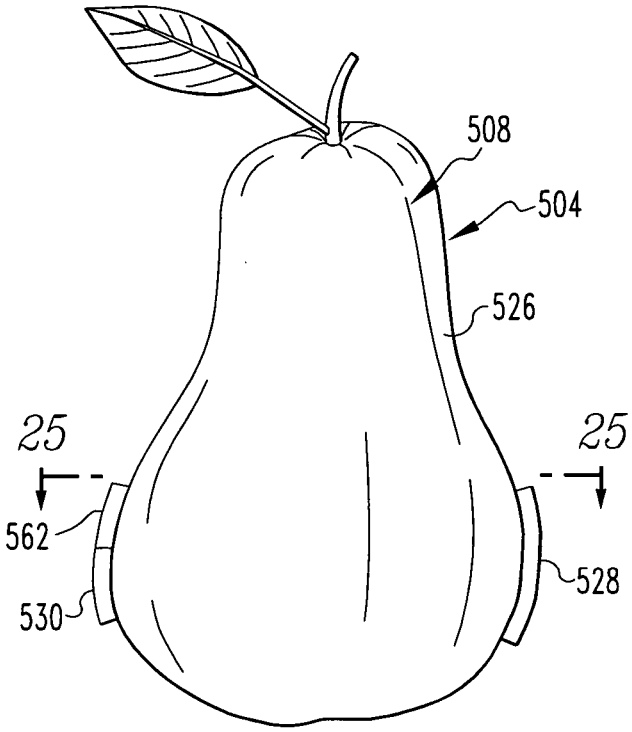
FIG. 24 is a front elevational view of the sixth embodiment.
Figure 25:
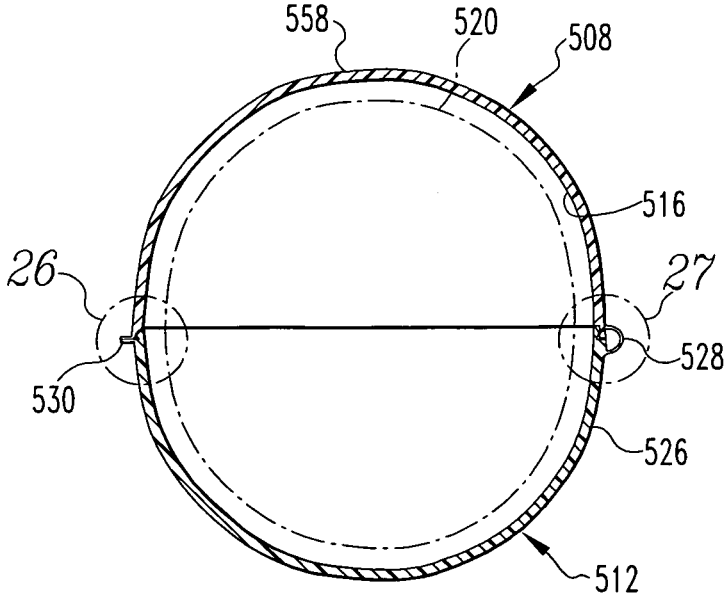
FIG. 25 is a sectional view as taken along the line 25—25 of FIG. 24.
Figure 26:
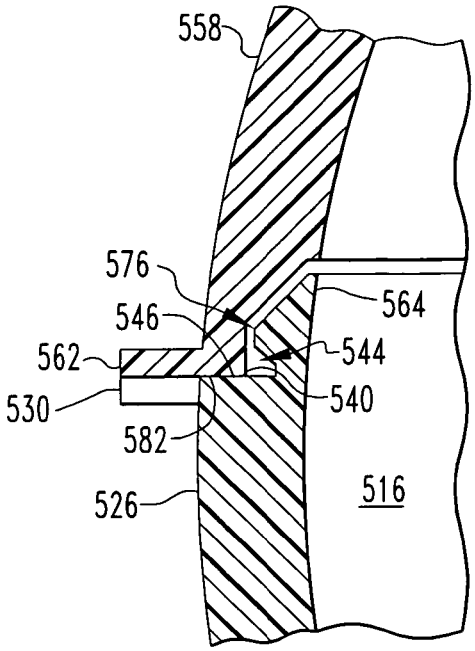
FIG. 26 is an enlarged view of an encircled portion of FIG. 25.
Figure 27:
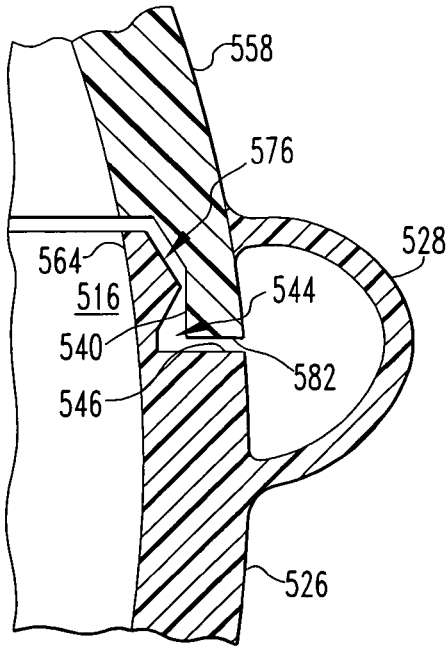
FIG. 27 is an enlarged view of an encircled portion of FIG. 25.
Figure 28:
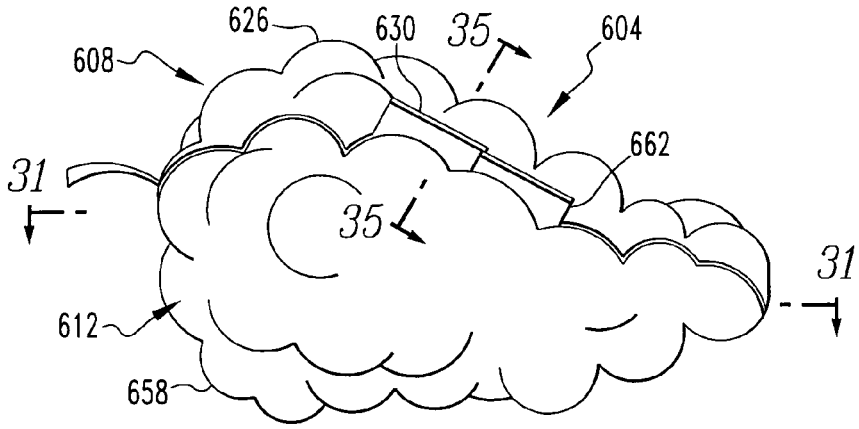
FIG. 28 is a front elevational view of a protective food storage container in accordance with a seventh embodiment of the present invention.
Figure 29:
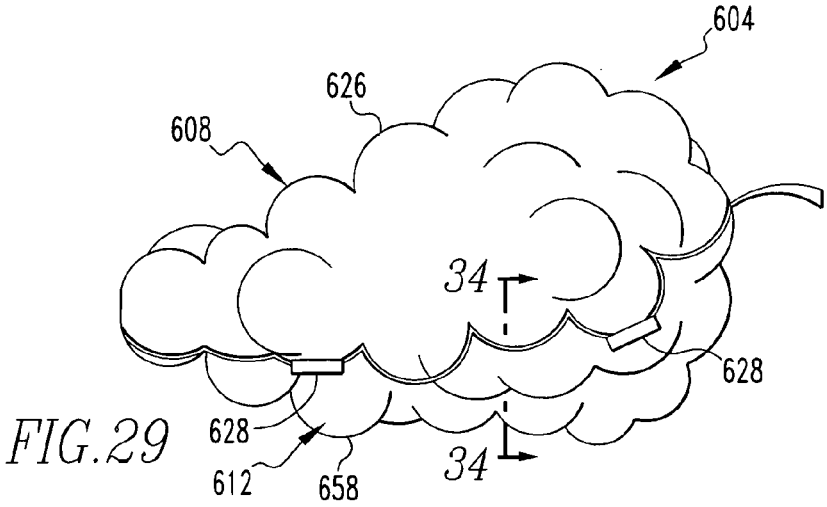
FIG. 29 is a rear elevational view of the seventh embodiment.
Figure 30:
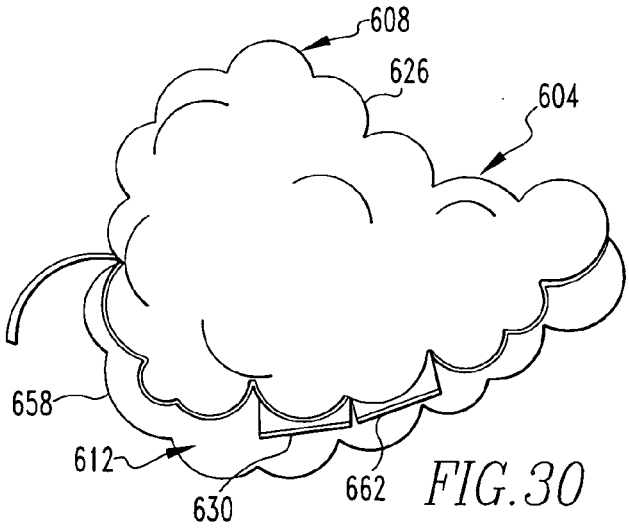
FIG. 30 is a top plan view of the seventh embodiment.
Figure 31:
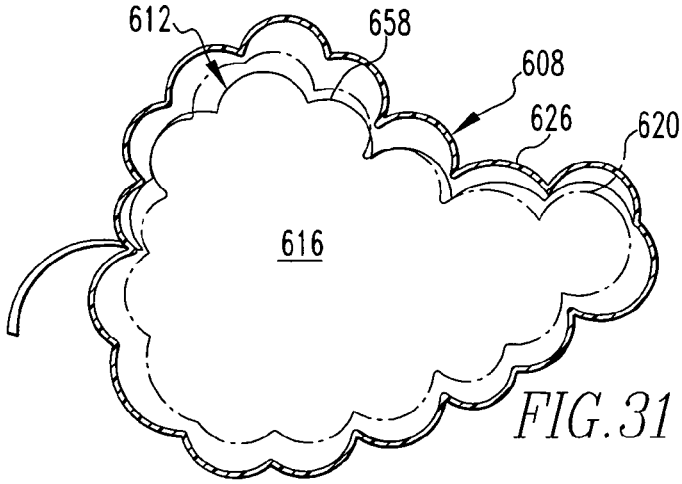
FIG. 31 is a sectional view as taken along line 31—31 of FIG. 28.
Figure 32:
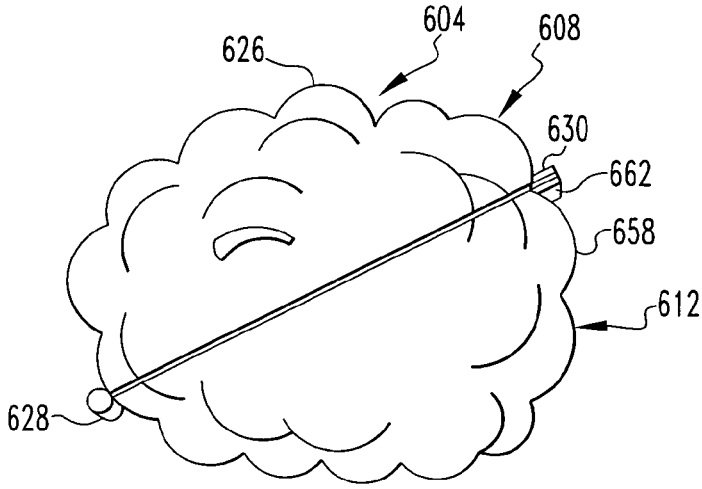
FIG. 32 is a left side elevational view of the seventh embodiment.
Figure 33:
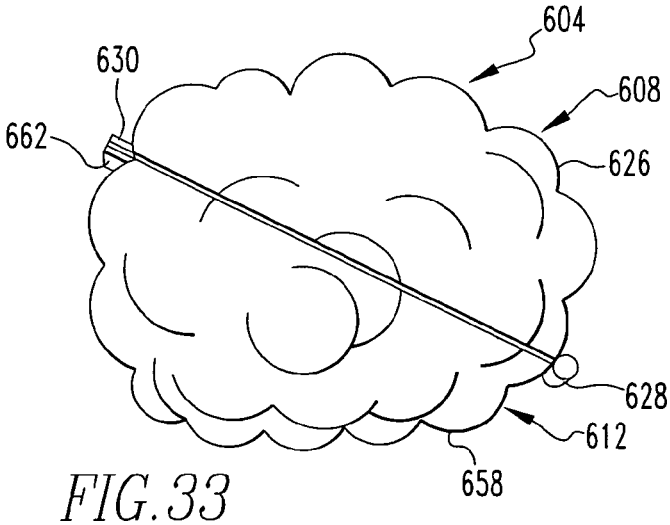
FIG. 33 is a right side elevational view of the seventh embodiment.
Figure 34:
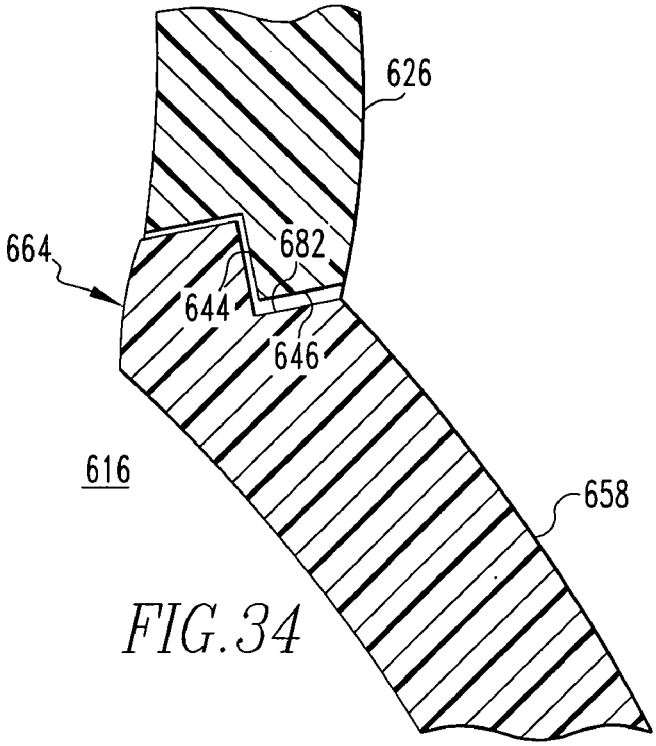
FIG. 34 is a sectional view as taken along line 34—34 of FIG. 29.
Figure 35:
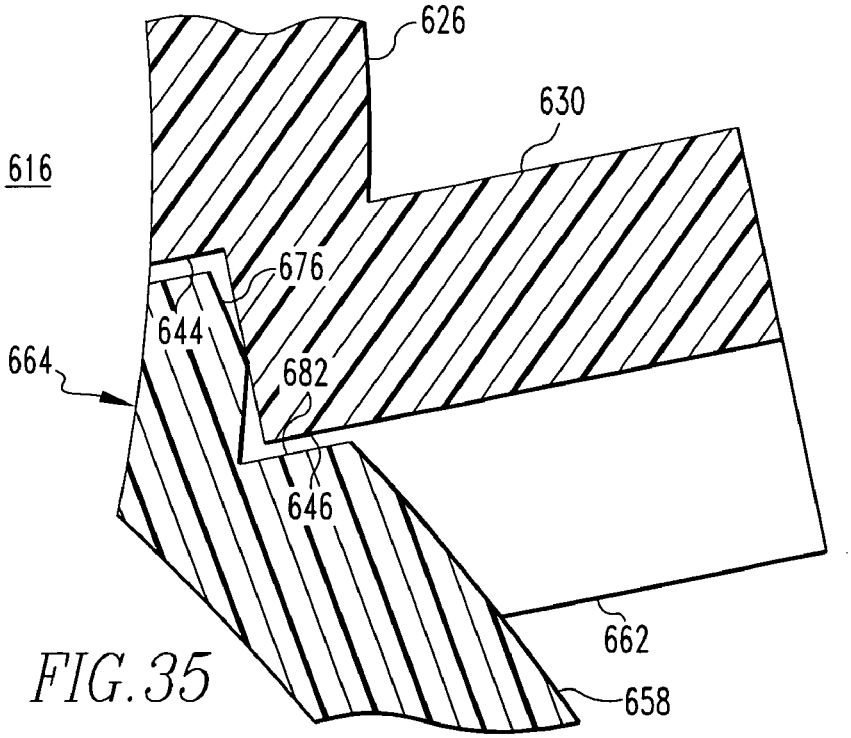
FIG. 35 is a sectional view as taken along line 35—35 of FIG. 28.

The boss 364 includes a protrusion 376 that protrudes radially outwardly from the boss 364. The protrusion 376 is depicted in FIGS. 13–15 as extending along substantially the entire circumference of the boss 364. It is understood, however, that in other embodiments the protrusion 376 may extend along less than the entire circumference of the boss 364, and may, for instance, extend only along the portion of the boss 364 adjacent the first and second tabs 330 and 362.

The protrusion 376 includes a tapered insertion surface 380 that facilitates reception of the boss 364 in the socket 344, as will be set forth more fully below. The protrusion 376 further includes a tapered removal surface 386 opposite the tapered insertion surface 380 that facilitates disengagement of the first and second members 308 and 312 from one another.

As is best shown in FIG. 15, the connection member 328 is a living hinge that is fixedly connected with each of the first and second members 308 and 312 near the first and second confronting faces 346 and 382, respectively. In this regard, the connection member 382 may be monolithically formed with the first and second members 308 and 312 as a single piece. It is understood, however, that the connection member 326 may be of a different configuration, such as in the form of a conventional hinge, a strap, a chain, or other such member. Other embodiments (not shown) of the container 304 may be configured to not include the connection member 328.

In operation, the container 304 can be used by placing the food item 320 in one of the first and second cavity portions 332 and 368 of the first and second members 308 and 312, and by pivoting the other of the first and second member 308 and 312 until the first and second members 308 and 312 are engaged with one another and the food item 320 is disposed in the cavity 316. Prior to engagement of the first and second members 308 and 312 with one another, the first and second members 308 and 312 are pivotable with respect to one another due to the natural flexibility of the connection member 328.

When the boss 364 is received in the socket 344, the protrusion 376 is disposed against and is engaged with the mounting surface 340. The container 304 is configured to provide a slight interference fit between the protrusion 376 and the mounting surface 340. The tapered insertion surface 380 facilitates insertion of the boss 364 into the socket 344 yet does not interfere with or weaken the engagement of the protrusion 376 with the mounting surface 340. Similarly, the tapered removal surface 386 facilitates disengagement of the boss 364 from the socket 344 without interfering with or diminishing the engagement of the protrusion 376 against the mounting surface 340.

In engaging the first and second members 308 and 312 together, it can be seen that pushing the first and second tabs 330 and 362 toward one another simultaneously and correspondingly causes the boss 364 to be received in the socket 344. The first and second tabs 330 and 362 are offset from one another so they generally do not engage one another. It can be seen that the first and second tabs 330 and 362 are disposed on the container 304 substantially opposite the connection member 328.

In order to disengage the boss 364 from the socket 344, the first and second tabs 330 and 362 are pushed away from one another by simultaneously pressing on the first and second surfaces 390 and 394. It thus can be seen that the first and second tabs 330 and 362 facilitate engagement and disengagement of the first and second members 308 and 312.

When the first and second members 308 and 312 are engaged with one another, the first and second confronting surfaces 346 and 382 are in a generally confronting orientation with respect to one another. The first and second confronting surfaces 346 and 382 are depicted in FIG. 15 as being slightly spaced from one another in the vicinity of the connection member 328. Such residual spacing may occur and be appropriate depending upon the configuration of the connection member 328. Opposite the connection member 328, however, the first and second confronting surfaces 346 and 382 are depicted as being engaged with one another. Moreover, the first and second surfaces 390 and 394 of the first and second tabs 330 and 362 are depicted as being generally coplanar. Such a confronting orientation between the first and second confronting surfaces 346 and 382 generally defines the engaged position for the first and second members 308 and 312 and results in the container 304 generally depicting the food item 320 when the first and second members 308 and 312 are engaged with one another.

With the food item 320 disposed within the cavity 316, the generally concave nature and the general rigidity of each of the first and second members 308 and 312 resists crushing of the container 304, which thus generally protects the food item 320 from bruising. Additionally, the cavity 316 is generally configured to correspond with the shape of the food item 320 such that the extent to which the food item 320 may move about freely within the cavity 316 is limited. As such, the configuration of the cavity 316 has the further effect of resisting bruising of the food item 320. Additionally, and as indicated above, the container 304 is structured to generally depict the food item 320.

The first and second tabs 330 and 362 facilitate engagement and disengagement of the first and second members 308 and 312. The engagement of the protrusion 376 with the mounting surface 340 retains the first and second members 308 and 312 engaged with one another, while the tapered insertion and removal surfaces 380 and 386 facilitate engagement and disengagement of the first and second members 308 and 312 without interfering with or diminishing the engagement of the protrusion 376 with the mounting surface 340.

A protective food storage container 404 in accordance with a fifth embodiment of the present invention is indicated generally in FIGS. 16–21. The container 404 is similar to the container 304 in that it includes a first member 408, a second member 412, and a connection member 428 extending therebetween, and is configured to include a cavity 416 formed therein within which a food item 420 can be protectively disposed. The container 404 is structured to generally depict the food item 420. The container 404 is different in that the food item 420 is a peach, and as such the container 404 is structured to generally depict a peach. As such, the first member 408 includes a first peach portion 426 and a first tab 430, and the second member 412 includes a second peach portion 458, a second tab 462 and a boss 464. The first and second members 408 and 412 are engageable with one another, with the boss 464 being engageable in a socket 444. More specifically, the boss 464 includes a protrusion 476 that is engageable with a mounting surface 440 of the socket 444. The protrusion 476 is configured to be similar to the protrusion 376 and is likewise configured to function in a similar capacity. The first member 408 includes a first confronting surface 446, and the second member 412 includes a second confronting surface 482, with the first and second confronting surfaces 446 and 482 being in a generally confronting orientation with respect to one another when the first and second members 408 and 412 are engaged with one another. The container 404 thus protectively retains a food item 420, such as a peach, therein and is structured to generally depict the food item 420, which for the container 404 is a peach. The container 404 generally resists bruising of the food item 420 in a fashion similar to the container 304.

A protective food storage container 504 in accordance with a sixth embodiment of the present invention is indicated generally in FIGS. 16–21. The container 504 is similar to the container 304 in that it includes a first member 508, a second member 512, and a connection member 528 extending therebetween, and is configured to include a cavity 516 formed therein within which a food item 520 can be protectively disposed. The container 504 is structured to generally depict the food item 520. The container 504 is different in that the food item 520 is a pear, and as such the container 504 is structured to generally depict a pear. As such, the first member 508 includes a first pear portion 526 and a first tab 530, and the second member 512 includes a second pear portion 558, a second tab 562 and a boss 564. The first and second members 508 and 512 are engageable with one another, with the boss 564 being engageable in a socket 544. More specifically, the boss 564 includes a protrusion 576 that is engageable with a mounting surface 540 of the socket 544. The protrusion 576 is configured to be similar to the protrusion 376 and is likewise configured to function in a similar capacity. The first member 508 includes a first confronting surface 546, and the second member 512 includes a second confronting surface 582, with the first and second confronting surfaces 546 and 582 being in a generally confronting orientation with respect to one another when the first and second members 508 and 512 are engaged with one another. The container 504 thus protectively retains a food item 520, such as a pear, therein and is structured to generally depict the food item 520, which for the container 504 is a pear. The container 504 generally resists bruising of the food item 520 in a fashion similar to the container 304.

A protective food storage container 604 in accordance with a seventh embodiment of the present invention is indicated generally in FIGS. 28–35. The container 604 is similar to the container 304 in that it includes a first member 608 and a second member 612 and is configured to include a cavity 616 formed therein within which a food item 620 can be protectively disposed. Also, the container 604 is structured to generally depict the food item 620. The container 604 is different in that the food item 620 is a bunch of grapes, and as such the container 604 is structured to generally depict a bunch of grapes. Moreover, the container 604 includes and a pair of connection members 628 that are spaced apart from one another and that extend between the first and second members 608 and 612.

The first member 608 includes a first grape portion 626 and a first tab 630, and the second member 612 includes a second grape portion 658, a second tab 662 and a boss 664. The first and second members 608 and 612 are engageable with one another, with the boss 664 being engageable in a socket 644. More specifically, the boss 664 includes a protrusion 676 that is engageable with a mounting surface 640 of the socket 644. The protrusion 676 is configured to be similar to the protrusion 376 and is likewise configured to function in a similar capacity. The first member 608 includes a first confronting surface 646, and the second member 612 includes a second confronting surface 682, with the first and second confronting surfaces 646 and 682 being in a generally confronting orientation with respect to one another when the first and second members 608 and 612 are engaged with one another. The container 604 thus protectively retains a food item 620, such as a bunch of grapes, therein and is structured to generally depict the food item 620 which, for the container 604, is a bunch of grapes. The container 604 generally resists bruising of the food item 620 in a fashion similar to the container 304.

It thus can be seen that the protective food storage containers 4, 104, 204, 304, 404, 504, and 604 protectively retain a food item 20, 120, 220, 320, 420, 520, and 620 therein, and additionally are structured to generally depict the food item. The containers 4, 104, 204, 304, 404, 504, and 604 thus provide an attractive container that is structured to generally depict the food item 20, 120, 220, 320, 420, 520, and 620 as well as protectively retain the food item therein while occupying minimal space.

The containers 4, 104, 204, 304, 404, 504, and 604 set forth above can be made of any of a wide variety of appropriate materials such as polyethylene, polypropylene, and other such plastic materials. Such plastic materials additionally may be butylated in order to provide desirable flexibility to a certain degree. If it is desired that such containers 4, 104, 204, 304, 404, 504, and 604, or portions thereof, be monolithically formed as a single piece, it may be desirable to form such single member by injection molding or other appropriate methodology.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A protective food storage container being formed with a cavity that is structured to receive a non-liquid food item therein, the protective food storage container comprising:

a first member;

a second member;

the first member and the second member being engageable with one another;

at least one of the first member and the second member including at least a first corrugation, the cavity being formed in at least one of the first member and the second member and extending at least partially through the at least first corrugation; and at least a portion of the first member and the second member engaged with one another being structured to generally depict the food item;

one of the first member and the second member including a protrusion and the other of the first member and the second member including a mounting surface, the protrusion being disposed against the mounting surface when the first member is engaged with the second member;

the protrusion being formed on a boss that projects from the one of the first member and the second member, the mounting surface being defined on a socket formed on the other of the first member and the second member, the boss being receivable in the socket; and the boss including a tapered insertion surface adjacent the protrusion.

2. The protective food storage container as set forth in claim 1, in which the first member and the second member are detachably connectable with one another.

3. The protective food storage container as set forth in claim 1, in which the cavity extends within at least a portion of both the first and second members.

4. The protective food storage container as set forth in claim 1, in which the first member includes a ring that is extendable at least partially around the second member.

5. The protective food storage container as set forth in claim 4, in which the ring is extendable around the at least first corrugation.

6. The protective food storage container as set forth in claim 1, in which the first member includes a connection member that is connected with the second member.

7. The protective food storage container as set forth in claim 6, in which the connection member is detachable from the second member.

8. The protective food storage container as set forth in claim 7, in which the connection member is detachable from the first member.

9. The protective food storage container as set forth in claim 8, in which the first member includes a lock member including and interior and a flexible retention member, an end of the connection member being removably receivable in the interior, the retention member being engageable with the end of the connection member to removably retain the end of the connection member in the interior.

10. The protective food storage container as set forth in claim 9, in which the lock member is recessed in the first member.

11. The protective food storage container as set forth in claim 9, in which the lock member extends outwardly from the first member.

12. The protective food storage container as set forth in claim 9, in which the connection member includes a bulb disposed at the end thereof.

13. The protective food storage container as set forth in claim 1, in which the protective food storage container is structured to generally depict a banana.

14. The protective food storage container as set forth in claim 1, in which the first member includes a first banana portion, and in which the second member includes a corrugated portion and a second banana portion, the corrugated portion being disposed between the first banana portion and the second banana portion.

15. A protective food storage container being formed with a cavity that is structured to receive a non-liquid food item therein, the protective food storage container comprising:

a first member, a second member;

the first member and the second member being engageable with one another;

at least one of the first member and the second member including at least a first corrugation, the cavity being formed in at least one of the first member and the second member and extending at least partially through the at least first corrugation;

at least a portion of the first member and the second member engaged with one another being structured to generally depict the food item; and in which the connection member includes a ring that is extendable at least partially around the second member.

16. The protective food storage container as set forth in claim 15, in which the ring is extendable around the at least first corrugation.

17. A protective food storage container being formed with a cavity that is structured to receive a non-liquid food item therein, the protective food storage container comprising:

a first member;

a second member; and a connection member extending between and connecting together the first member and the second member;

the first member and the second member being engageable with one another;

the cavity being formed in at least one of the first member and the second member; and at least a portion of the first member and the second member engaged with one another being structured to generally depict the food item;

one of the first member and the second member including a protrusion and the other of the first member and the second member including a mounting surface, the protrusion being disposed against the mounting surface when the first member is engaged with the second member;

the protrusion being formed on a boss that projects from the one of the first member and the second member, the mounting surface being defined on a socket formed on the other of the first member and the second member, the boss being receivable in the socket;

the boss including a tapered insertion surface adjacent the protrusion; and in which the first member includes a ring that is extendable at least partially around the second member.

18. The protective food storage container as set forth in claim 17, in which the connection member is a hinge.

19. The protective food storage container as set forth in claim 18, in which the connection member is a living hinge.

20. The protective food storage container as set forth in claim 17, in which one of the first member and the second member includes at least a first corrugation, and in which the ring is extendable around the at least first corrugation.

21. The protective food storage container as set forth in claim 17, in which a first tab is disposed on the first member and a second tab is disposed on the second member.

22. The protective food storage container as set forth in claim 21, in which the first and second tabs are disposed substantially adjacent one another when the first member is engaged with the second member.

23. The protective food storage container as set forth in claim 22, in which the first tab and the second tab are disposed substantially opposite the connection member.

* * * * *

UNITED STATES PATENT AND TRADEMARK OFFICE

CERTIFICATE OF CORRECTION

PATENT NO. : 6,942,097 B1
DATED : September 13, 2005
INVENTOR(S) : Paul Stremple et al.

It is certified that error appears in the above-identified patent and that said Letters Patent is hereby corrected as shown below:

Column 13,
Line 13, should read -- a first member;
a second member; --.

Signed and Sealed this

Twenty-ninth Day of November, 2005

JON W. DUDAS
*Director of the United States Patent and Trademark Office*